US007421996B2

(12) United States Patent
Oki

(10) Patent No.: US 7,421,996 B2
(45) Date of Patent: Sep. 9, 2008

(54) LUBRICATING DEVICE FOR ENGINE

(75) Inventor: Kenji Oki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/539,375

(22) Filed: Oct. 6, 2006

(65) Prior Publication Data

US 2007/0079789 A1 Apr. 12, 2007

(30) Foreign Application Priority Data

Oct. 11, 2005 (JP) ..... 2005-296590

(51) Int. Cl.

| | |
|---|---|
| ***F02F 7/00*** | (2006.01) |
| ***F01M 11/03*** | (2006.01) |
| ***F01M 1/02*** | (2006.01) |
| ***F01M 11/02*** | (2006.01) |

(52) U.S. Cl. ..... 123/195 C; 123/196 R; 123/196 A

(58) Field of Classification Search ..... 123/195 C, 123/195 CP, 196 A, 196 R See application file for complete search history.

(56) References Cited

U.S. PATENT DOCUMENTS 3,961,614 A * 6/1976 Rameau ..... 123/195 A
4,616,610 A * 10/1986 Ishida ..... 123/196 A
6,640,769 B2 * 11/2003 Nomura et al. ..... 123/196 R
2002/0007984 A1 1/2002 Ito et al.
2004/0084250 A1 5/2004 Morii et al.
2004/0245050 A1 12/2004 Kawamoto et al.
2005/0039718 A1 2/2005 Tsutsumi et al.

FOREIGN PATENT DOCUMENTS

| | | |
|---|---|---|
| DE | 89 11 897 U1 | 12/1989 |
| GB | 2156 450 A | 10/1985 |
| JP | 11-311126 A | 11/1999 |

* cited by examiner

*Primary Examiner*—Stephen K. Cronin
*Assistant Examiner*—Ka Chun Leung
(74) *Attorney, Agent, or Firm*—Westerman, Hattori, Daniels & Adrian, LLP.

(57) ABSTRACT

An lubrication device for an engine includes: a crank case which freely rotatably supports a crank shaft and also which stores oil at its lower part; an oil strainer which is so arranged as to be fixed in the crank case; and an oil pump which suctions the oil at the lower part in the crank case via the oil strainer. In the lubricating device, the machining efficiency can be improved by reducing the time of machining to a crank case to thereby decentralize machining processes, and also the oil temperature can be reduced. A crank case cover covering part of a crank case and coupled with the crank case is provided with an oil suction passage which leads to an oil pump, and an oil strainer communicates with the oil suction passage via a connecting pipe which is a member different from the crank case.

3 Claims, 5 Drawing Sheets

LUBRICATING DEVICE FOR ENGINE

BACKGROUND OF THE INVENTION

The present invention relates to a lubricating device for an engine provided with a crank case which freely rotatably supports a crank shaft and also which stores oil at its lower part, an oil strainer which is so arranged as to be fixed in the crank case, and an oil pump which sucks the oil at the lower part in the crank case via the oil strainer.

Already known, for example, by Japanese Patent document JP-A No. H11-311126 is an oiling device which has, in a crank case made up a pair of case half bodies mutually coupled together on a plane including a cylinder axis, an oil strainer so arranged as to be supported by one of the case half bodies, an oil pump fitted to the other one of the case half bodies, and an oil suction passage linking between the oil strainer and the oil pump.

SUMMARY OF THE INVENTION

However, with the oiling device disclosed in JP-A No. H11-311126, described above, one of the pair of case half bodies forming the crank case needs to be subjected to machining for forming the oil suction passage, resulting in machining concentrated on the crank case, which is far from excellent machining efficiency. In addition, during passage through the oil suction passage provided in the crank case, heat from a cylinder block side has influence on the oil temperature.

In view of this circumstance, the invention has been made, and it is an object of the invention to provide an oiling device for an engine capable of improving the machining efficiency by reducing the time of machining to be provided to a crank case to thereby decentralize machining processes and also to reduce the oil temperature.

To achieve the object described above, the invention refers to an oiling device for an engine characterized by including: a crank case which freely rotatably supports a crank shaft and also which stores oil at bottom thereof, an oil strainer which is fixed in the crank case; and an oil pump which sucks the oil at the bottom in the crank case via the oil strainer, in which a crank case cover covering part of the crank case and coupled with the crank case is provided with an oil suction passage which leads to the oil pump, and the oil strainer communicates with the oil suction passage via a connecting pipe which is a member different from the crank case.

Further, the instant invention is characterized in that in addition to the configuration described above the crank case cover is shaped into a bottomed cylinder having an end wall part of a flat-plate-like shape, and at least part of the oil suction passage is formed in the end wall part.

In addition to the configuration described above the oil pump may be fitted to an inner surface of the crank case cover.

Still further, at least part of the oil suction passage is so formed as to extend in a same direction as a mold-drawing direction of the crank case cover which is subjected to molding.

According to the invention described above, the oil suction passage is provided in the crank case cover covering part of the crank case and coupled with this crank case, and the oil strainer and the oil suction passage communicate with each other via the connecting pipe which is a member different from the crank case. This therefore permits: reducing the man-hour of machining to be provided to the crank case to thereby decentralize machining processes, thus improving the machining efficiency; and also preventing the effect of heat from the cylinder block 22 side from being exerted on oil flowing through the oil suction passage 78, thus reducing the oil temperature.

Additionally, oil flowing through the oil suction passage can be cooled by external air with which the outer surface of the crank case cover makes contact Still further, the structure is such that the oil pump and the crank case are arranged separately from each other, thereby making it difficult for the effect of the heat from the crank case to be exerted on the oil pump, and thus permitting preventing an oil temperature increase.

Additionally, at least part of the oil suction passage can be simultaneously formed upon molding of the crank case cover, thus permitting reducing the man-hour of machining.

BRIEF DESCRIPTION OF THE DRAWINGS

Hereinafter, an embodiment of the present invention will be described in conjunction with the accompanying drawings.

FIG. 1 is a left side view of a scooter-type motorcycle;

FIG. 2 is a right side view of a major part of an engine;

FIG. 3 is a sectional view, taken on line 3-3 of FIG. 2;

FIG. 4 is a longitudinal sectional view of an engine, taken along line 4-4 of FIG. 3; and FIG. 5 is a sectional view, taken on line 5-5 of FIG. 2.

DETAILED DESCRIPTION OF THE INVENTION

Figure 1:
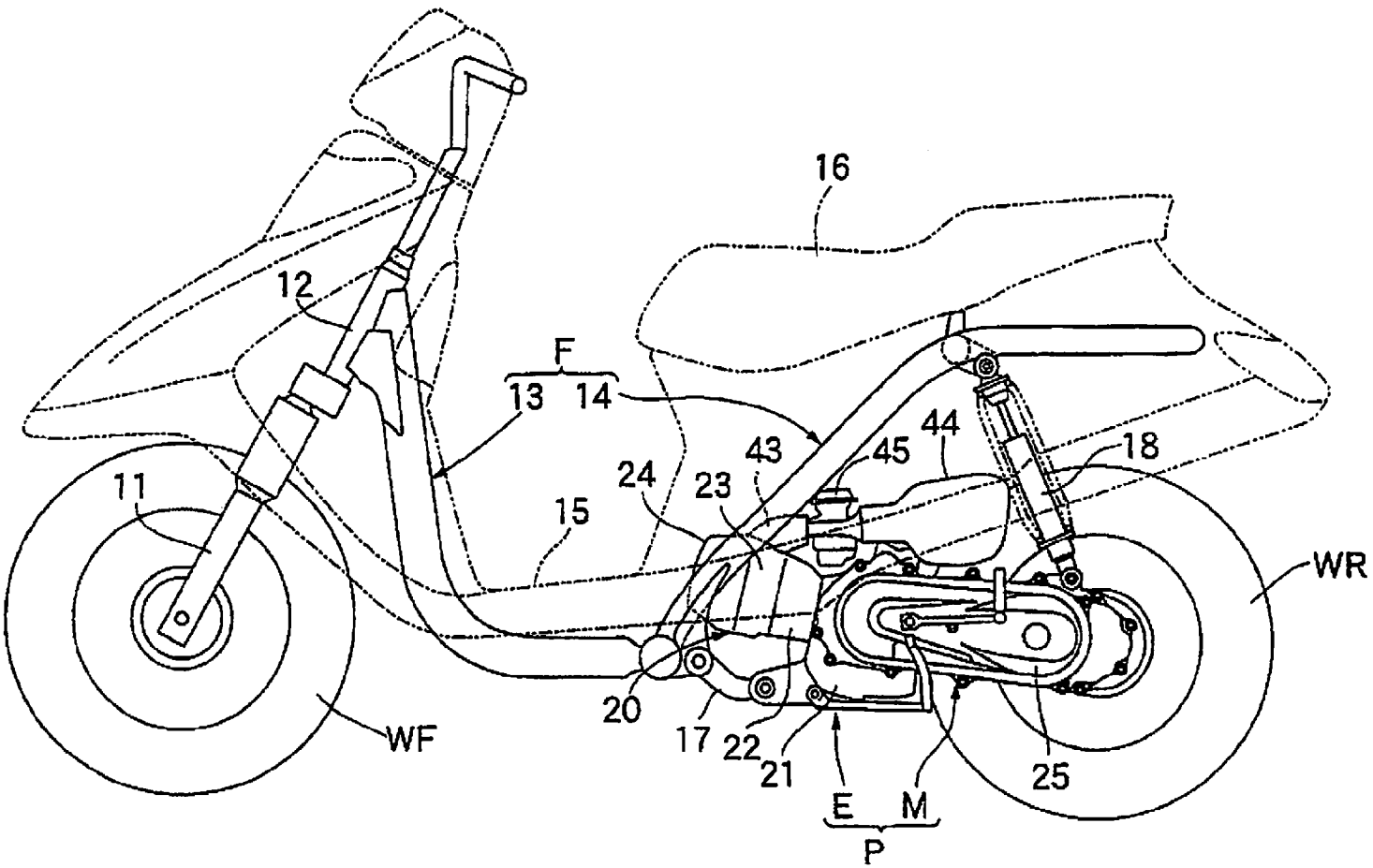
FIGS. 1 to 5 show an embodiment of the invention.

First, in FIG. 1, a vehicle body frame F of the scooter-type motorcycle includes: a front frame 13 which extends downward toward the rear from a head pipe 12 steerably supporting a front fork 11 pivotably supporting a front wheel WF and which supports a step floor 15; and a rear frame 14 which extends upward toward the rear from the rear part of the front frame 13 and which supports an occupant seat 16. In the vehicle body frame F, a power unit P which includes an engine E and a belt-type continuously variable transmission M, which continuously varies the power of engine E transmitted to a rear wheel WR. Power unit P is suspended via a suspension link 17 in such a manner as to be vertically swingable. Between the rear frame 14 and the power unit P, a rear damper 18 is provided for damping the vertical swinging of the power unit P.

Figure 2:
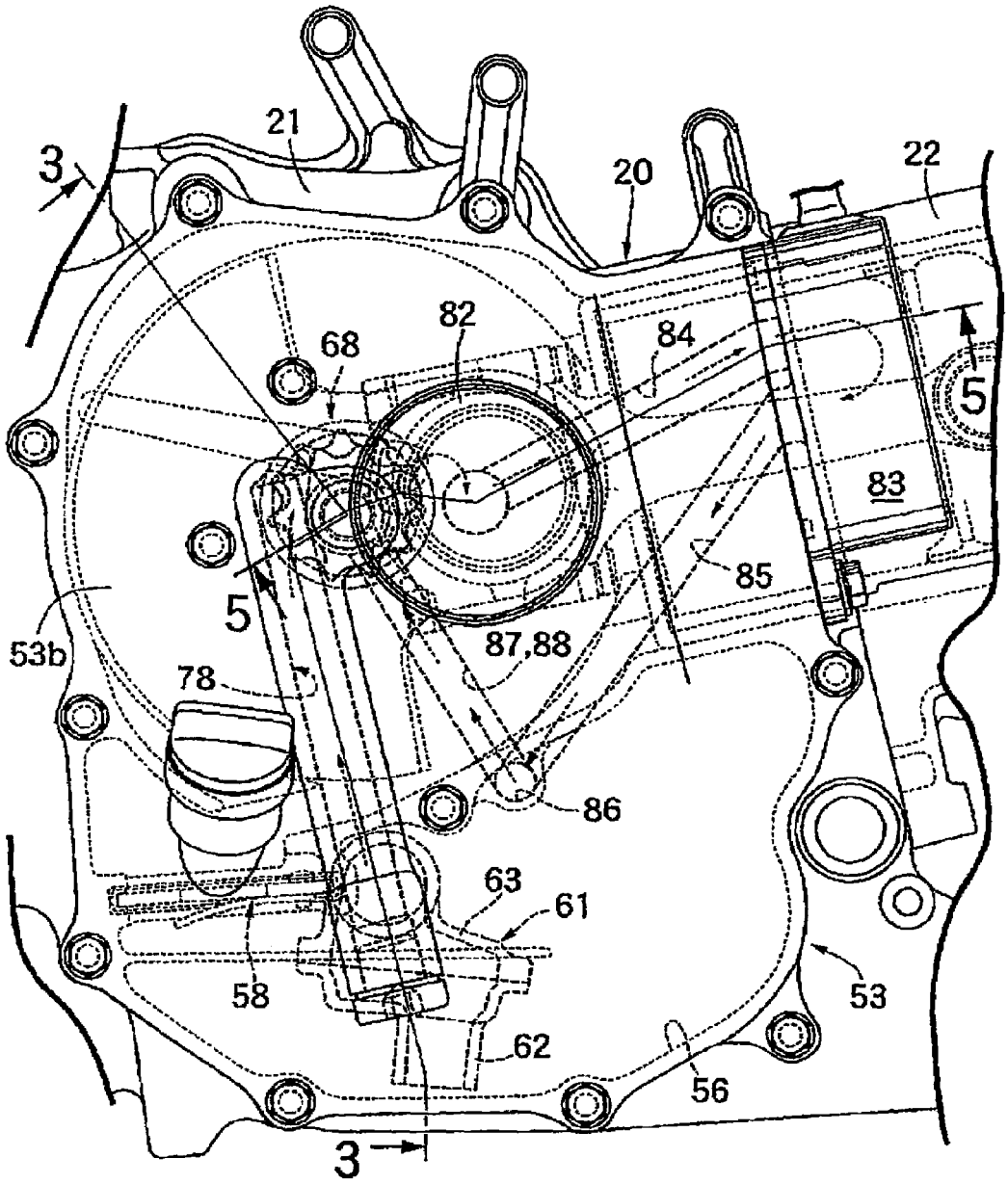
Figure 3:
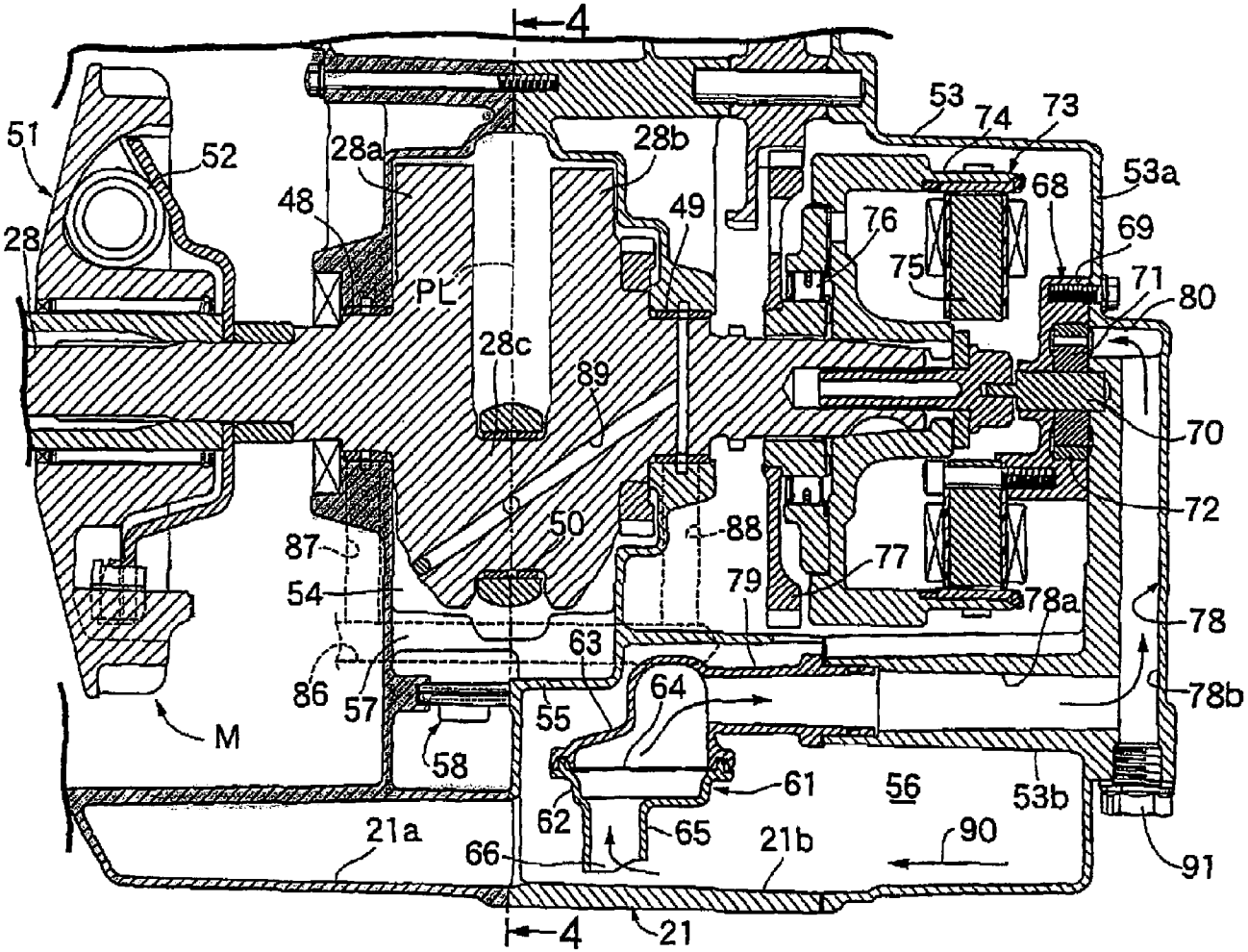
Figure 4:
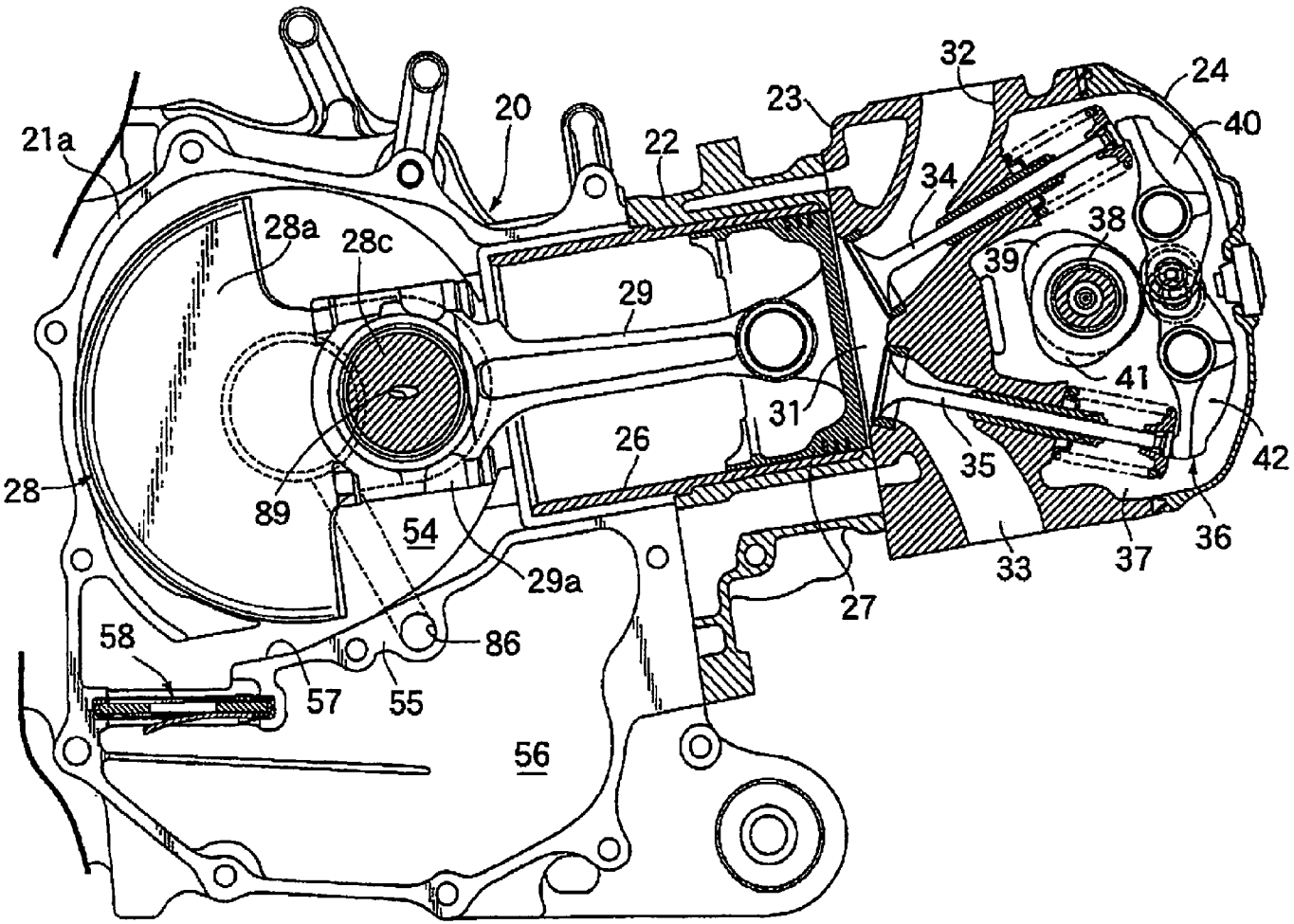

Referring to FIGS. 2 to 4 together, an engine body 20 of the engine E is provided with: a crank case 21; a cylinder block 22 which is coupled with the front end of the crank case 21 with its head bent forward; a cylinder head 23 which is coupled with the front end of the cylinder block 22; and a head cover 24 which is coupled with the cylinder head 23. Moreover, as clearly shown in FIG. 1, a transmission case 25 which stores the continuously variable transmission M is coupled with the left side surface of the crank case 21 as oriented forward in the moving direction of the motorcycle. On the rear of the transmission case 25 extending rearward from the crank case 21, the rear wheel WR is journalled.

A cylinder liner 26 of a cylindrical shape is connected to the cylinder block 22, wherein the cylinder liner 26 extends to the inside of the crank case 21. A piston 27 is freely slidable inside of cylinder liner 26. On the other hand, a crank shaft 28 with an axis extending in the width direction of the motorcycle is freely rotatably supported at the crank case 21. Crank shaft 28 integrally has a pair of crank webs **28*a* and 28*b* which are opposed to each other with a gap axially provided therebetween, and a crank pin 28*c* which links crank webs 28*a* and 28*b*. Piston 27 is joined to crank pin 28*c* via a connecting rod 29**.

Focusing on FIG. 4, a combustion chamber 31 facing the apex of piston 27 is formed between cylinder block 22 and cylinder head 23. An intake port 32, which leads to the combustion chamber 31, is provided in cylinder head 23 in such a manner as to open the top side surface of the cylinder head 23. An exhaust port 33, which leads to combustion chamber 31, is provided in the cylinder head 23 in such a manner as to open the bottom side surface of the cylinder head 23.

In the cylinder head 23, an intake valve 34 for controlling the flow of air-fuel mixture from the intake port 32 into the combustion chamber 31, and an exhaust valve 35 for controlling the flow of exhaust gas from the combustion chamber 31 to the exhaust port 33 are so provided as to be capable of opening and closing operations. A valve system 36 which drives the suction valve 34 and the exhaust valve 35 to open and close is stored in a valve chamber 37 formed between the cylinder head 23 and the head cover 24.

Moreover, the valve system 36 is provided with: a cam shaft 38 which rotates by a power transmitted from the crank shaft 16 at a reduction ratio of 1/2; an intake side rocker arm 40 which oscillates following an intake side cam 39 provided in the cam shaft 38 to drive the intake valve 34 to open and close; and an exhaust rocker arm 42 which oscillates following an exhaust side cam 41 provided in the cam shaft 38 to thereby drive the exhaust valve 35 to open and close.

Moreover, as shown in FIG. 1, an intake pipe 43 leading to the intake port 32 is connected to the top side surface of the cylinder head 23, and intake pipe 43 is connected via a carburetor 45 to an air cleaner 44 arranged above the transmission case 25.

The crank case 21 includes a pair of case half bodies 21*a* and 21*b* which are dividably coupled together on a coupling surface along a plane PL including a cylinder axis, that is, the axis of the cylinder liner 26 and also orthogonal to the axis of the crank shaft 28. The crank shaft 28 is freely rotatably supported, at the outside of a pair of crank webs 28*a* and 28*b* integrally provided therein, to both the case half bodies 21*a* and 21*b* of the crank case 21 via ring-shaped metal bearings 48 and 49. A large end 29*a* of the connecting rod 29 is joined with the crank pin 28*c* of the crank shaft 28 via a ring-shaped metal bearing 50.

To one end of the crank shaft 28 protruding from the left side case half body 21*a*, a drive pulley 51 is fitted which is a part of the continuously variable transmission M. The radius of belt-winding around this drive pulley 51 changes depending on the displacement of a weight 52 in accordance with the rotation speed of the crank shaft 28.

A crank case cover 53 which covers the right side surface of the crank case 21 is coupled with the right side case half body 21*b*. Crank case cover 53 is shaped into a bottomed cylinder having an end wall part 53*a* of a flat-plate-like shape, with the opening end thereof coupled with the case half body 21*b* of the crank case 21.

Inside the crank case 21, a crank chamber 54 is formed which houses both the crank webs 28*a* and 28*b* and the crank pin 28*c* of the crank shaft 28. An oil storage chamber 56, sandwiching a partition wall 55 provided in the crank case 21 with the crank chamber 54, is formed at the bottom of the crank case 21 and in the crank case cover 53.

In the lower part of the partition wall 55, an oil collecting hole 57 is provided which collects oil dropping inside the crank chamber 54, and also a reed valve 58 is disposed which only permits oil flow from the oil collecting hole 57 to the oil storage chamber 56. Thus, oil is stored inside the oil storage chamber 56.

An oil strainer 61 is fixed in a portion of the oil storage chamber 56 at a lower part of the case half body 21*b* which constructs the crank case 21 together with the case half body 21*a* Oil strainer 61 is formed by holding a filtering member 64 between a bottom case 62 and a top case 63 mutually coupled together, with a suction pipe 65 being integrally formed with the bottom case 62 in such a manner as to have a bottom end opening part thereof, that is, a suction port 66, open downward. Moreover, the suction port 66 is arranged near the plane PL including the cylinder axis and also orthogonal to the axis of the crank shaft 28, that is, near the coupling surface of both the case half bodies 21*a* and 21*b* in the crank case 21.

Oil inside the oil storage chamber 56 is suctioned by an oil pump 68 via the oil strainer 61. This oil pump 68 is fitted, concentrically with the crank shaft 28, to the inner surface of the end wall part 53*a* in the crank case cover 53.

Figure 5:
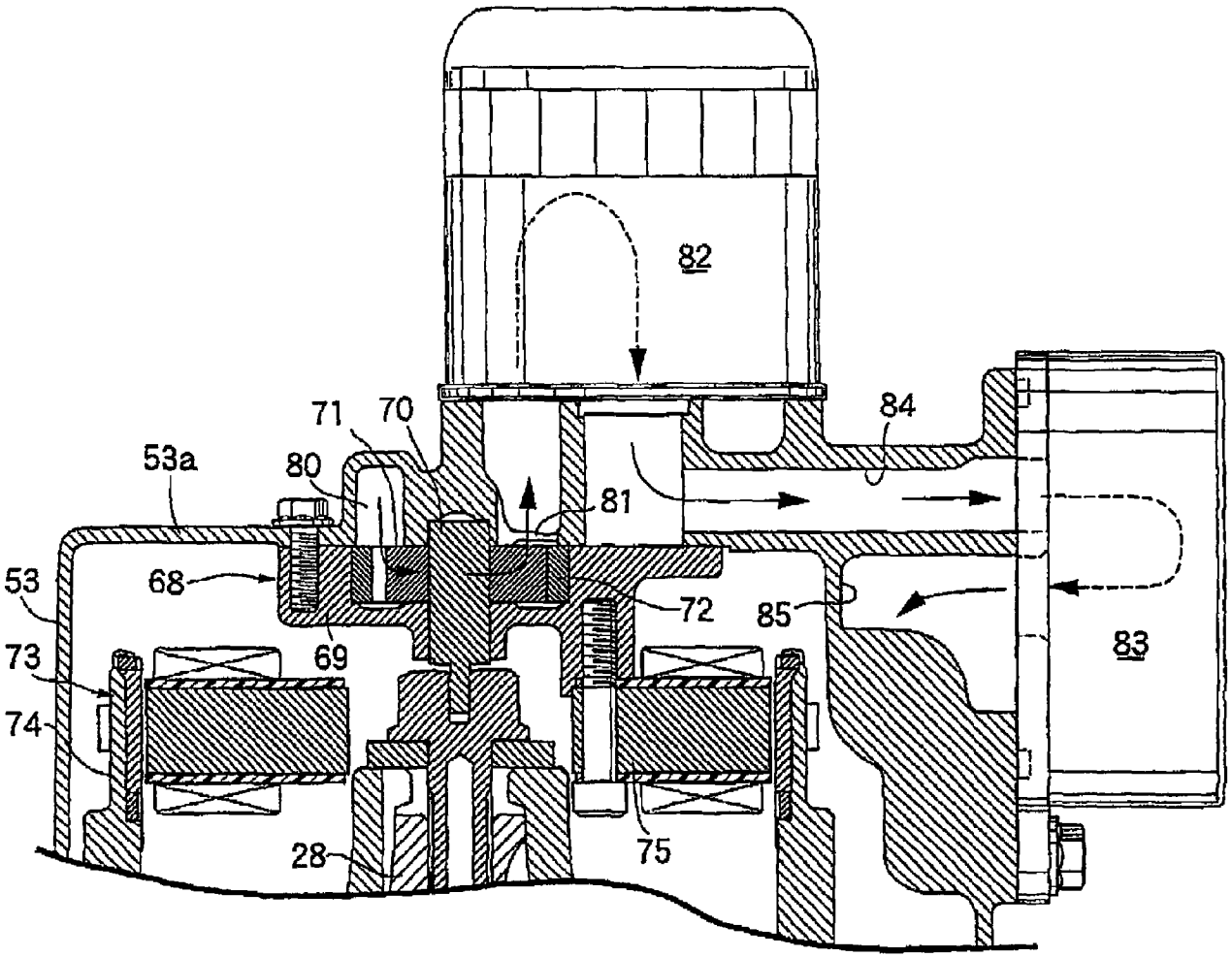

Additionally referring also to FIG. 5, the oil pump 68 is of a trochoid type, and is formed by storing, between the inner surface of the end wall part 53*a* in the crank case cover 53 and a pump case 69 fastened to this end wall part 53*a*, an inner rotor 71 fixed to a pump shaft 70 and an outer rotor 72 meshing with this inner rotor 71, with one end of the pump shaft 70, which freely rotatably penetrates through the pump case 69, being joined with the other end of the crank shaft 28 concentrically therewith and also in such a manner as to be incapable of relative rotation. That is, the oil pump 68 is driven to rotate by the crank shaft 28.

To the crank shaft 28 on the inner side of the oil pump 68, an outer rotor 74 of an electric generator 73 is fixed. In addition, an inner stator 75 constructing the electric generator 73 together with the outer rotor 74 is fixed to the pump case 69. Moreover, with the outer rotor 74, a gear 77 is joined via a one-way clutch 76. This gear 77 is interlocked and joined with a staring motor, not shown.

In the crank case cover 53, an oil suction passage 78 is provided which leads to the oil pump 68. The oil strainer 61 leads to the oil suction passage 78 via a connecting pipe 79 which is a member different from the crank case 21.

To the end wall part 53*a* of the crank case cover 53, a pipe part 53*b* is integrally provided which extends to the oil strainer 61 side. The connecting pipe 79 is also integrally formed with the top case 63 in the oil strainer 61. A tip of the connecting pipe is liquid-tightly fitted with a tip of the pipe part 53*b*.

The oil suction passage 78 is formed of an upstream passage part 78*a* formed in the pipe part 53*b* and leading into the connecting pipe 79, and a downstream side passage part 78*b* formed in the end wall part 53*a* of the crank case cover 53. The downstream passage part 78*b* is formed in the end wall part 53*a*, extending linearly so as to link together the upstream passage part 78*a* and a suction port 80 of the oil pump 68.

Moreover, the crank case cover 53 is formed by molding such as casting or the like. The upstream side passage part 78*a* is so formed as to extend in the same direction as a mold-drawing direction 90 of the crank case cover 53 which is subjected to molding. The downstream passage part 78*b* is formed by drilling from a side opposite to the oil pump 68 after molding, and the end opening part of the downstream side passage part 78*b* located opposite to the oil pump 68 is closed by a cover member 91.

Thus, at least part of the oil suction passage 78, i.e., the downstream passage part 78*b* in this example, is formed in the end wall part 53*a* of the crank case cover 53, and at least part of the oil suction passage 78, i.e., the upstream passage part 78*a* in this example, is so formed as to extend in the same direction as the mold-drawing direction 90 of the crank case cover 53 which is subjected to molding.

An exhaust port 81 of the oil pump 68 is, as clearly shown in FIG. 5, connected to an oil filter 82 fitted to the outer surface of the end wall part 53*a* in the crank case cover 53. Oil cleaned by this oil filter 82 is led to an oil cooler 83 fitted to the front side surface of the crank case cover 53 via an oil passage 84 provided in the end wall part 53*a*. Oil cooled by the oil cooler 83 is led, via an oil passage 85 provided in the crank case cover 53, to a main gallery 86 extending in parallel with the axis of the crank shaft 28 and provided in the crank case 21.

Oil led to the main gallery 86 is delivered upward from a pair of oil passages 87 and 88 provided in the crank case 21, and is used for lubrication of the metal bearings 48 and 49 supporting the crank shaft 28. Further, in the crank shaft 28, on the metal bearing 50 side between the crank pin 28*c* and the connecting rod 29, an oil passage 89 is provided which draws oil from the metal bearing 49 side.

Next, the operation will be described. The oil suction passage 78 leading to the oil pump 68 is provided in the crank case cover 53 covering part of the crank case 21 and coupled with crank case 21, and the oil strainer 61 communicates with the oil suction passage 78 via the connecting pipe 79 which is a member different from the crank case 21. This therefore permits: reducing the time for machining to the pair of case half bodies 21*a* and 21*b* foaming the crank case 21 to thereby decentralize machining processes, thus improving the machining efficiency; and also preventing the effect of a heat from the cylinder block 22 side from being exerted on oil flowing through the oil suction passage 78, thus reducing the oil temperature.

The suction port 66 of the oil strainer 61 so arranged as to be fixed in the crank case 21 is arranged near the flat surface PL including the cylinder axis and also orthogonal to the axis of the crank shaft 28. Thus, even when the top surface of oil in the oil storage chamber 56 slightly moves horizontally upon turning of the scooter-type motorcycle or by oscillation of the engine body 21, air suction by the suction port 66 can be prevented.

The crank case cover 53 is shaped into a bottomed cylinder having the end wall part 53*a* of a flat-plate-like shape, and at least part of the oil suction passage 78, i.e., the downstream passage part 78*b* in this example, is formed in the end wall part 53*a*, thus permitting oil flowing through the oil suction passage 78 to be cooled by outside air with which the outer surface of the crank case cover 53 makes contact.

The oil pump 68 is fitted to the inner surface of the end wall part 53*a* in the crank case cover 53, which permits structure such that the oil pump 68 and the crank case 21 are formed separately from each other, thereby making it difficult for the effect of heat from the crank case 21 to be exerted on the oil pump 68, and thus preventing an oil temperature increase.

Further, at least part of the oil suction passage 78, i.e., the upstream passage part 78*a* in this example, is so formed as to extend in the same direction as the mold-drawing direction 90 of the crank case cover 53 which is subjected to molding, thus permitting at least part of the oil suction passage 78 (the upstream passage part 78*a* in this example) to be simultaneously formed upon molding of the crank case cover 53, which in turn permits reducing the time of machining.

The embodiment of the invention has been described above, although the invention is not limited to the embodiment described above. Thus, various design modifications can be made without departing from the invention described in the scope of claims.

I claim:

1. A lubricating device for an engine, comprising:

a crankcase which freely rotatably supports a crankshaft and which stores oil at a lower part thereof;

an oil strainer fixed in the crankcase;

an oil pump which sucks oil in the lower part of said crankcase by way of said oil strainer; and a crankcase cover, covering part of said crankcase and coupled therewith, having an oil suction passage which communicates with said oil pump, wherein said oil strainer communicates with said oil suction passage by way of a connecting pipe, wherein said oil strainer and said connection pipe are separate from said crankcase, wherein said crankcase cover is shaped into a bottomed cylinder having an end wall part of a flat-plate-like shape, and at least part of said oil suction passage is formed in said end wall part, and further wherein said crankcase cover forms at least part of an outer surface of said engine.

2. The lubrication device of claim 1, wherein said oil pump is fitted to an inner surface of said crankcase cover.

3. The lubrication device of claim 1, wherein at least part of said oil suction passage is formed so as to extend in a same direction as a mold-drawing direction of said crankcase cover which is subjected to molding.

* * * * *